United States Patent [19]

Kajiwara

[11] 4,194,382

[45] Mar. 25, 1980

[54] ROLLING MILL

[75] Inventor: Toshiyuki Kajiwara, Hitachi, Japan

[73] Assignee: Hitachi, Ltd., Tokyo, Japan

[21] Appl. No.: 851,203

[22] Filed: Nov. 14, 1977

[30] Foreign Application Priority Data

Nov. 26, 1976 [JP] Japan ..... 51/141141
Mar. 14, 1977 [JP] Japan ..... 52/27054

[51] Int. Cl.[2] ..... B21B 29/00; B21B 35/12; B21B 31/32

[52] U.S. Cl. ..... 72/243; 72/249; 72/245

[58] Field of Search ..... 72/241-243, 72/249, 237, 245

[56] References Cited

U.S. PATENT DOCUMENTS

| | | | |
|---|---|---|---|
| 1,206,746 | 11/1916 | Worth | 72/241 |
| 1,522,473 | 1/1925 | Chartener | 72/243 |
| 1,700,054 | 1/1929 | Iversen | 72/241 |
| 1,847,713 | 3/1932 | Gibbons | 72/241 X |
| 1,953,190 | 4/1934 | Paterson | 72/243 |
| 2,776,586 | 1/1957 | Sendzimir | 72/242 |
| 3,024,679 | 3/1962 | Fox | 72/245 |
| 3,076,360 | 2/1963 | Sendzmir | 72/242 |
| 3,172,313 | 3/1965 | Fox | 72/241 X |
| 3,398,564 | 8/1968 | Barten | 72/243 |
| 3,626,739 | 12/1971 | Willeke et al. | 72/237 |
| 3,818,743 | 6/1974 | Kajiwara | 72/243 |
| 3,857,268 | 12/1974 | Kajiwara | 72/247 |
| 3,902,345 | 9/1975 | Shida | 72/8 |

OTHER PUBLICATIONS

"New Process. . .", Bosenberg et al., Sheet Metal Industries, Jul., 1973, pp. 397-399.
Hitachi Hyoron, vol. 56, No. 10, 3-8, 1974.
Tetsu To Kou, Koen Ronbun Syu, 241, 1976.
Iron & Steel Engr., 3/1975, "Taylor Mill-A New Development in Light Gage Rolling", Ballintine & Taylor.

*Primary Examiner*—Milton S. Mehr
*Attorney, Agent, or Firm*—Thomas E. Beall, Jr.

[57] ABSTRACT

A rolling mill comprises a pair of upper and lower work rolls, upper and lower backup rolls respectively backing those work rolls, upper and lower intermediate rolls interposed respectively between the upper work roll and upper backup roll and between the lower work roll and lower backup roll, and benders connected to the upper and lower intermediate rolls, respectively. This arrangement enables the surfaces of the upper and lower work rolls in contact with a material to be rolled to be made substantially rectilinear.

32 Claims, 10 Drawing Figures

ROLLING MILL

LIST OF PRIOR ART REFERENCES (37 CFR 1.56 (a))

The following references are cited to show the state of the art:

U.S. Pat. No. 3,818,743 Kajiwara et al.: June 25, 1974 243
U.S. Pat. No. 3,857,268 Kajiwara: Dec. 31, 1974 247
U.S. Pat. No. 3,902,345 Shida: Sept. 2, 1975 8
U.S. Pat. No. 3,076,360 Sendzimir: Feb. 5, 1963 80–38
U.S. Pat. No. 3,024,679 Fox: Mar. 13, 1962 80–56
HITACHI HYORON, Vol. 56, No. 10 3–8 (1974)
TETSU TO KOU, KOEN RONBUN SYU, 241 (1976)
SHEET METAL INDUSTRIES, 397–399 (1973)

BACKGROUND OF THE INVENTION

This invention relates to rolling mills, and more specifically to a multiple-staged rolling mill effective for the shape control of the material to be rolled.

It is well-known with rolling mills for strips that the upper and lower work rolls are bent and deflected by the reaction force acted upon by the strip, with the result that the strip tends to develop defects of shape, such as edge wave or elongation, plate crown in which the longitudinal middle portion of the strip is increased in thickness, and so on, upon rolling. Also it is known that during high speed rolling or in rolling light metal materials the contacting surfaces of the work rolls are so deformed by thermal expansion as to make the strip ununiform in thickness across its width, thinning the middle portion of the strip and thereby causing middle elongation and other defects.

Attempts to prevent those defects of shape have been made. For example, rolling mills of recent designs include roll benders connected either to the upper and lower work rolls or to the upper and lower backup rolls so that increased or decreased bending forces may be applied, when necessary, on the work rolls or backup rolls. Those roll benders, which cause changes in the work roll crown according to the cross sectional profile of the strip or the rolling force used for the rolling operation, are generally believed fairly helpful in avoiding the defects of shape in the strip upon rolling.

However, the experience in the past years with those mills incorporating roll benders has revealed that the increased bending forces applied by the benders associated with the work rolls or backup rolls are not in the least effective in arresting complex elongation, or the combination of edge and middle elongations, even though the forces may suppress the edge waves along. It has also been empirically found that decreased bending forces produced by the benders connected to the work rolls are substantially ineffective in controlling the middle and edge elongations.

The problems of the existing mills equipped with roll benders will now be more fully analyzed. First, discussion will be made in connection with a four high mill of a conventional design having roll benders connected to the upper and lower work rolls so as to apply increased bending forces on those rolls.

As is commonly known, the upper and lower work rolls during rolling operation are deformed by the reaction force of the strip being rolled, with the middle portions of those work rolls bent away from each other. As a result, the strip tends to be rolled to an increased thickness in the middle portion across its width, producing waves along the both edges. In an effort to alleviate these unfavorable tendencies, modern mills have roll benders connected to the both ends of the work rolls and thereby apply increased bending forces in such a way as to force the both ends of the upper and lower work rolls away from the strip to be rolled. The application of increased bending forces on the work rolls is expected to correct the axis of the upper work roll, allowing it to draw either a rectilinear line or a secondary line convexed downwardly. Actually, however, the axis draws a wide-W-shaped curve, convex upwardly in the middle of the roll and concave in the both end portions. Accordingly, the edge portions of the strip, each extending over about one-fourth of the total width, are subjected to intense rolling forces and therefore tend to develop complex waveness or elongations, or a combination of edge and middle waves, upon rolling.

In order to deflect the upper work roll until its axis draws a downwardly convex secondary curve, it is necessary to deflect the upper backup roll, too, because the work roll is under constraints of its backup roll and the strip being rolled. However, it must be noted that the backup roll has by far the greater rigidity than the work roll and is subjected at both ends to a heavy load which is the sum of the rolling load and the increased bending forces applied. Thus, the axis of the upper backup roll is deflected, drawing an upwardly convex secondary curve. Now if increased bending forces are given to the upper work roll, that roll and the upper backup roll will be pressed hard against each other in the portions where they are free from the reaction force of the strip. Those portions of the upper work roll are deformed by the upper backup roll acting as levers, while the middle portion of the upper work roll constrained by the upper backup roll and the strip does not draw a downwardly convex secondary curve. After all, the upper work roll is deformed so that its axis forms a wide-W-shaped curve.

With a prior art four high mill of the modified design having roll benders connected to both upper and lower backup rolls in order to apply increased bending forces on those rolls, the increased bending forces cause the backup rolls to deflect at the opposite ends away from the strip, thus solving the afore-described problems of the conventional four high mill having work rolls equipped with roll benders. Still, the modified mill in turn poses new problems as follows:

(a) With work rolls of a small diameter and low rigidity, the shape control of the strip is satisfactorily accomplished by applying bending forces on the backup rolls. Ordinary work rolls, by contrast, do not deflect to a desirable curve as they remain unaffected by the deformation of the backup rolls upon subjection to increased bending forces. The axes of the work roll undergo little change, whereas the axes of the backup rolls are changed to horizontally straight lines under the action of the increased bending forces.

(b) Where work rolls of a small diameter and low rigidity are used, backup rolls must be of a sufficiently large diameter to secure the necessary rigidity. However, the backup rolls of high rigidity require large-capacity benders for the bending purposes. Moreover, they must be equipped with powerful bearings to withstand the large bending load produced by the large-capacity benders in addition to the rolling load by the screwdown mechanism.

(c) Where the backup rolls are to be equipped with benders, the distances between the points of application of bending forces and the rolling force must be long enough to allow large bending moments to be given to the backup rolls. This necessitates the adoption of long necks for the backup rolls and, as a result, involves difficulties in installing roll-changing devices and other auxiliary arrangements.

Next, a four high mill of the type including benders connected to the upper and lower work rolls so as to apply decreased bending forces on those rolls will be considered.

In case of high speed rolling or in rolling light metal materials on this type of mill, the heat generated by rolling causes the work rolls to expand particularly in the middle portion. The strip accordingly tends to be rolled with decreased thickness in the middle portion, resulting in middle elongations or waviness. In order to repress this tendency, modern mills include roll benders connected to the both ends of the upper and lower work rolls and adapted to apply decreased bending forces to the work rolls so as to force the both ends of the rolls toward the strip to be rolled. It is intended by the application of decreased bending forces to make the surface of the upper work roll in contact with the strip substantially rectilinear or convex upwardly. Actually, on the contrary, the roll is deformed to a generally wide-W-shaped curve, convex downwardly in the middle and upwardly in the both end portions. Middle and edge waves, therefore, are left behind in the rolled product. The reasons for which the contacting surface of the upper work roll is deformed in such a manner have already been explained and the explanation is not repeated here.

As regards this problem, the same may be said of a rolling mill of the type having benders connected to the upper and lower backup rolls to apply decreased bending forces to those rolls.

SUMMARY OF THE INVENTION

The present invention aims at providing a rolling mill capable of rolling a strip with a high accuracy through maintenance of the straightness of the surface of its work rolls in contact with the strip.

In accordance with the invention, the object is realized by a rolling mill comprising a pair of upper and lower work rolls defining therebetween a nip for a material to be rolled, upper and lower backup rolls respectively backing the upper and lower work rolls, an intermediate roll interposed in at least one of positions between the upper work roll and the upper backup roll and between the lower work roll and the lower backup roll, and means associated with the intermediate roll to apply bending forces on the same.

Preferably another intermediate roll may be disposed between the other work roll and the associated backup roll and additional means may be associated with that intermediate roll to apply bending forces thereon.

Also, desirably, means for applying bending forces on the upper and lower work rolls may be associated with those rolls.

Further, the effective working surface of each of the backup rolls may be less in longitudinal length than that of each of the intermediate rolls which, in turn, may be less in longitudinal length than that of each of the work rolls.

BRIEF DESCRIPTION OF THE DRAWING

Other objects, features and advantages of the present invention will become more clear with respect to the drawing, wherein like numerals are provided for the like parts, and wherein:

Referring to FIG. 1, a mill indicated generally at 1 comprises a set of upper and lower work rolls 3 and 4 defining a nip for a strip 2 to be worked, and a set of backup rolls 5 and 6 backing, respectively, the upper and lower work rolls. The mill 1 also comprises upper and lower intermediate rolls 7 and 8 interposed, respectively, between the upper work roll 3 and the upper backup roll 5 and between the lower work roll 4 and the lower backup roll 6. As shown in the drawing, each of the intermediate rolls 7 and 8 has a diameter greater than that of each of the work rolls 3 and 4, but less than the diameter of each of the backup rolls 5 and 6. The effective working surface of each of the intermediate rolls 7 and 8 is the same in longitudinal length as those of the backup and work rolls or, in other words, the rolls are all in contact all over their lengths. To each end of the intermediate rolls 7 and 8 are coupled a bender 9 for applying an increased bending force and a bender 10 for applying a decreased bending force. These benders for the rolls function in such a manner that, when the benders 9 are operative and the bender 10 inoperative, the former give bending moments to the intermediate rolls and force the opposite ends of each of the upper and lower intermediate rolls away from the strip 2. Conversely, when the benders 9 are inoperative and the benders 10 operative, the latter provide bending moments so as to force the opposite ends of each of the two intermediate rolls toward the strip.

Figure 2:
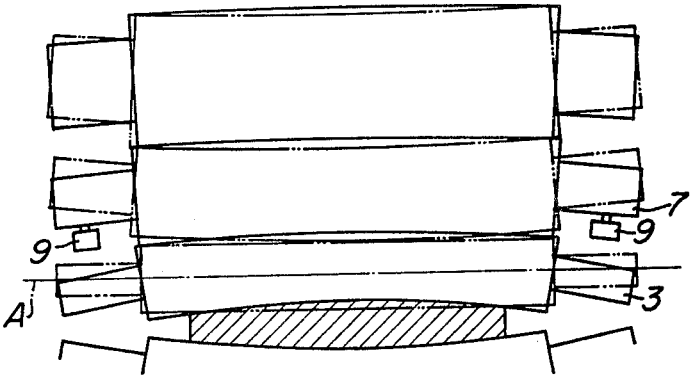
FIG. 2 is a diagrammatic front view of essential parts showing rolls deformed by the application of increased bending forces on an intermediate roll.

While the both benders 9 and 10 remain inoperative during rolling operation, the axes of the upper work roll 3 and the upper intermediate roll 7 are deflected convexly upwardly by the reaction force of the strip 2 being worked, as indicated by continuous lines in FIG. 2. Now if the benders 9 are actuated and increased bending forces are exercised on the both ends of the upper intermediate roll 7, the roll 7 will be deflected downwardly convexly as indicated by two-dot chain lines in FIG. 2. The work roll 3 with less rigidity will be straightened, its axis being on the level as indicted by a single-dot chain line A. Consequently, the strip 2 is rolled to a shape dependent upon the initial crown of the work roll 3, and is protected against the edge wave referred to above.

Figure 3:
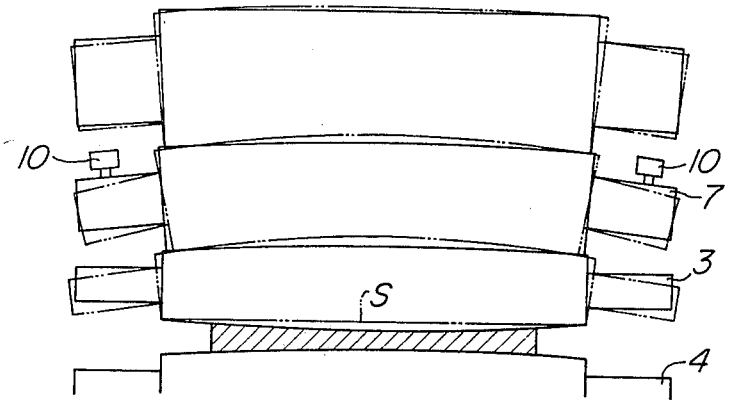
FIG. 3 is a view similar to FIG. 2 but showing the rolls deformed by the application of decreased bending forces on the intermediate roll.

When operating at high speed or handling light metal, the mill generates sufficient heat to cause expansion of the work rolls 3 and 4; the surface of the upper work roll 3 in contact with the strip 2 sags downward, while the contacting surface of the lower work roll 4 is deformed convexly upwardly as shown in continuous lines in FIG. 3. The benders 10, when turned on, apply decreased bending forces on the both ends of the intermediate rolls 7 and 8, making the surfaces S of the work rolls 3 and 4 in contact with the strip substantially rectilinear as represented, for example, by a two-dot chain line in FIG. 3. In this way the abovementioned middle waviness is precluded.

Moreover, the intermediate rolls disposed between the backup and work rolls lessen the constraints of the backup rolls on the work rolls, because the intermediate rolls each have a diameter or rigidity greater than that of each work roll, but less than that of each backup roll. They serve as buffers between the two types of rolls and transmit less constraints from the backup rolls in a moderate way to the work rolls, thus eliminating the possibility of complex waviness.

The addition of benders to the intermediate rolls that already have a high degree of freeness enhances the bending effect.

As described above, the mill according to the invention includes intermediate rolls interposed between the work rolls and backup rolls, and roll benders connected to the intermediate rolls. The work rolls, therefore, are not excessively constrained by the backup rolls but are allowed freely to follow the deformation of the intermediate rolls so as to take many variable contours.

The deformation of the intermediate rolls is facilitated by using the backup rolls of an effective working surface shorter in longitudinal length than the intermediate rolls. This permits the provision of a mill capable of adequate shape control.

Figure 1:
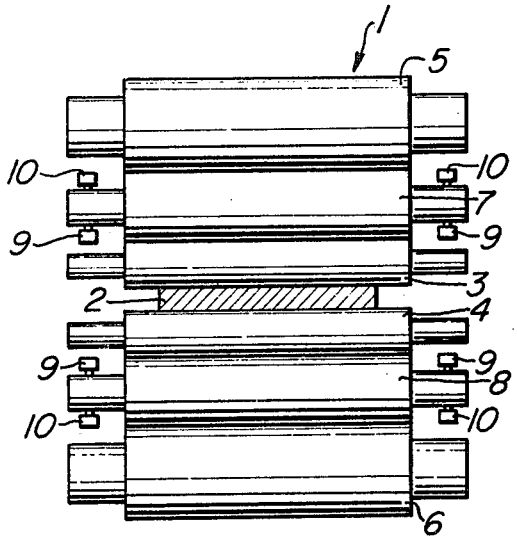
FIG. 1 is a diagrammatic front view of a first embodiment of the rolling mill according to the invention.
Figure 4:
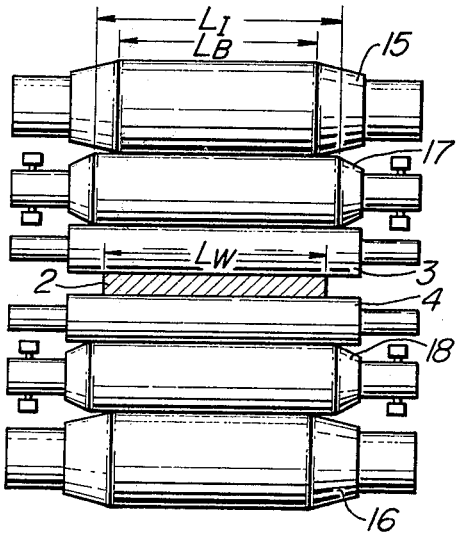
FIG. 4 is a diagrammatic front view of a second embodiment of the rolling mill of the invention, in which the backup and intermediate rolls have successively decreased longitudinal lengths in effective working surfaces.

In FIG. 4 there is shown a second embodiment of the invention, with the members and parts like those in FIG. 1 being given like numbers. Here the longitudinal length LB of the effective working surface of each of the backup rolls 15 and 16 is less than that $L_I$ of each of the intermediate rolls 17 and 18. This arrangement keeps the both ends of each of the intermediate rolls out of contact with those of each of the backup rolls, protecting the former from any excessive constraint of the latter. As a result, a rolling mill is provided which is satisfactorily controllable for accuracy in shape, without the well-known shortcomings of the conventional four high mills.

Even better shape control will be attained with the embodiment of FIG. 4, if the longitidinal length $L_B$ of the effective working surface of each of the backup rolls 15 and 16 is less than not only that $L_I$ of each of the intermediate rolls 17 and 18 but also the maximum width $L_W$ of the strip 2 to be rolled.

Figure 5:
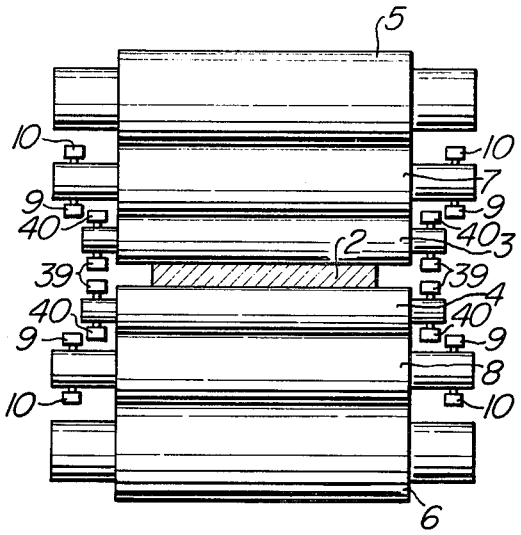
FIG. 5 is a diagrammatic front view of a third embodiment of the invention, in which benders are connected to the intermediate and work rolls.

FIG. 5 illustrates a third embodiment of the invention, with the members and parts like those in FIG. 1 being given like numbers. In this embodiment, like the intermediate rolls 7 and 8 having the roll benders 9 and 10, the work rolls 3 and 4 are equipped with roll benders 39 and 40. The benders 39 are designed to apply increased bending forces, and the benders 40 decreased bending forces, on the work rolls.

In the mill of the construction shown in FIG. 5, the work rolls 3 and 4 can be deflected to various contours as desired by exercising increased or decreased bending forces while, at the same time, subjecting the work rolls to increased or decreased bending forces. As a consequence, the rolling conditions may be changed according to the cross sectional profile of the workpiece being handled.

Figure 6:
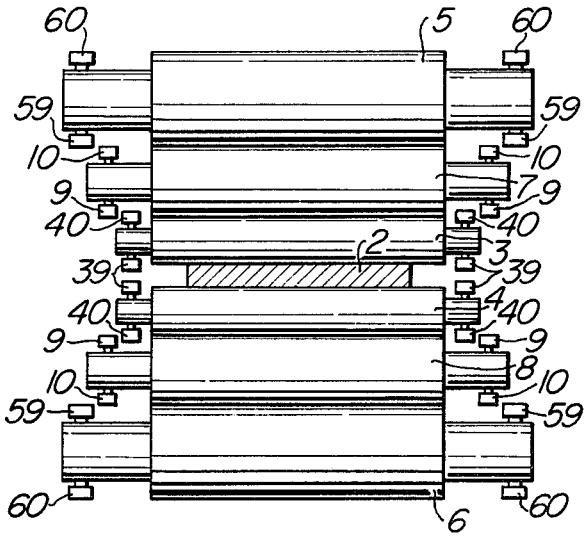
FIG. 6 is a diagrammatic front view of a fourth embodiment of the invention, in which benders are connected to all of the rolls.

A fourth embodiment of the invention is depicted in FIG. 6, wherein the counterparts of the members and parts shown in FIG. 5 are designated by like numerals. The mill illustrated is further modified in construction so that the embodiment of FIG. 5 includes additional benders 59 and 60 attached to the backup rolls 5 and 6. The benders 59 are used to give increased bending forces, and the benders 60 decreased bending forces, to the backup rolls. This arrangement ensures even more accurate shape control of the work rolls 3 and 4.

Where the strip need not be rolled to a very high level of dimensional accuracy across its width or where sufficient space is not provided for the both upper and lower intermedite rolls, either roll may be omitted.

Figure 7:
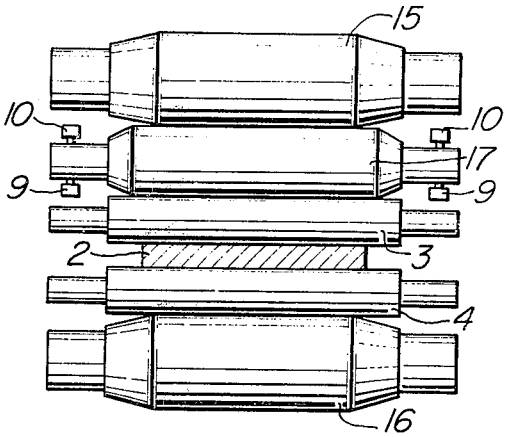
FIG. 7 is a diagrammatic front view of a fifth embodiment of the invention, in which only one intermediate roll is interposed between the upper work roll and upper backup roll.

FIG. 7 shows a fifth embodiment of the invention. In the figure like members and parts are given like numbers with respect to FIG. 4. This embodiment dispenses with the lower intermediate roll. Only between the upper work roll 3 and the upper backup roll 15 is disposed an intermediate roll 17, to which benders 9 and 10 are attached. Although the embodient shown is inferior in performance to the embodiments already described in connection with FIGS. 1 through 6, it can be retrofitted without major modifications in existing four high mills.

It is a well-known practice for the economy of energy to use a set of work rolls for ordinary mills one of which is smaller in diameter than the other. By so doing the rolling load and power requirement can be reduced. A further effect of energy saving would be achieved by driving only the work roll on either side, for example, the lower work roll.

Figure 8:
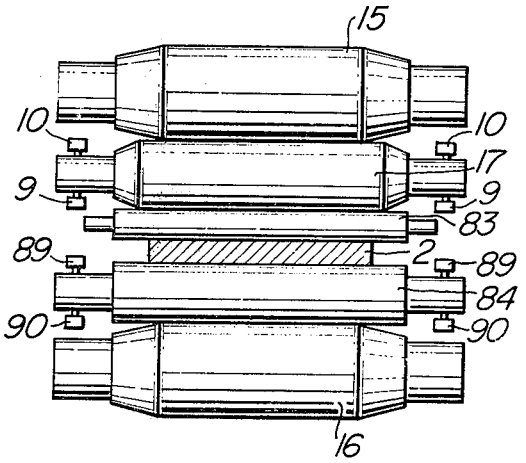
FIG. 8 is a diagrammatic front view of a sixth embodiment of the invention, in which one of the upper and lower work rolls is smaller in diameter than the other and a bender is connected to the other work roll.

In FIG. 8 is shown a sixth embodiment of the invention, with members and parts like those in FIG. 7 given like numbers. This embodiment uses an upper work roll 83 of a small diameter, about two-thirds to one-fourth of the diameter of a lower work roll 84. Again the only intermediate roll 17 is interposed between the upper backup roll 15 and the upper work roll 83. Desirably the lower work roll 84 is of greater rigidity than conventional work rolls, and it is associated with benders 89 and 90.

Figure 9:
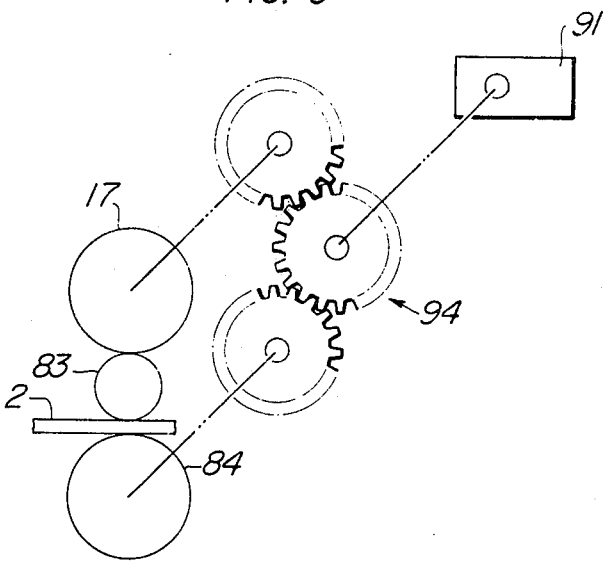
FIGS. 9 and 10 are schematic views illustrating driving systems for the mill shown in FIG. 8.
Figure 10:
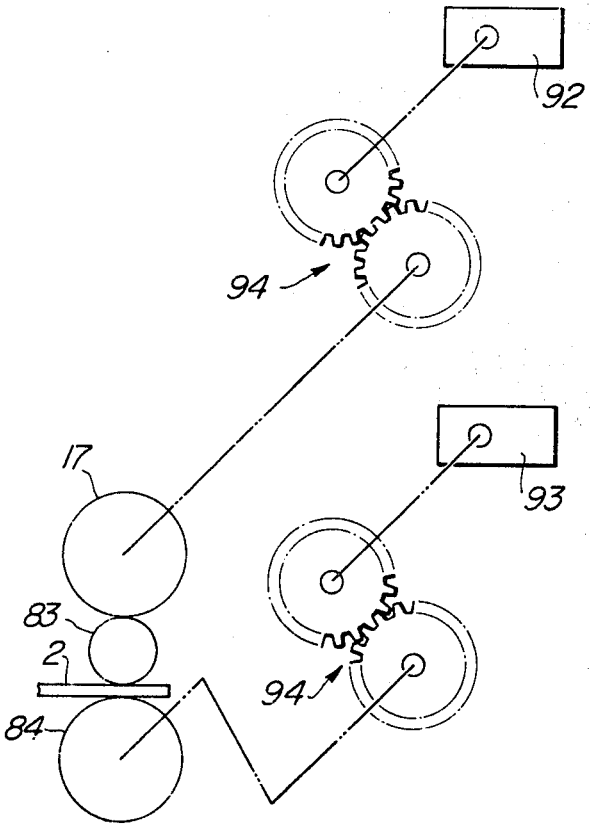

Next, driving systems for the embodiment shown in FIG. 8 will be described with reference to FIGS. 9 and 10.

If the small-diameter work roll 83 is too slender to be driven, there will be the alternative of driving the large-diameter work roll 84 alone or driving that roll together with the intermediate roll 17. FIG. 9 shows an arrangement in which a motor 91 drives the large-diameter work roll 84 and the intermediate roll 17. FIG. 10 shows two motors 92 and 93 driving those rolls 84 and 17 separately. In either case, the driving power from each motor is transmitted through gears 94 to the roll or rolls. In this way the driving power is properly distributed among the upper and lower rolls to prevent slipping between the rolls and the strip (inasmuch as the small-diameter roll has a lower slip limit than the larger ones) and also to economize energy.

Preferred embodiments of the present invention have been described in detail for the purposes of illustrating the broader invention and the importance of the details, with further embodiments, modifications and variations contemplated, all within the spirit and scope of the following claims.

I claim:

1. A rolling mill comprising a pair of upper and lower work rolls defining therebetween a nip for material to be rolled, upper and lower backup rolls respectively backing said upper and lower work rolls, an intermediate roll interposed in at least one of positions between said upper work and the lower backup roll, said intermediate roll having a diameter and rigidity greater than the diameter and rigidity of the adjacent one of said work rolls and having a diameter less than the diameter of the backup rolls, and means associated with said intermediate roll to apply bending forces on the same.

2. A rolling mill according to claim 1, wherein one of said upper and lower work rolls associated with said intermediate roll has a diameter about two-thirds to one-fourth of that of the other work roll, and the mill further comprises means associated with said other work roll to apply bending forces on the latter.

3. A rolling mill according to claim 2, wherein each of said upper and lower backup rolls has an effective working surface less in longitudinal length than that of said intermediate roll.

4. A rolling mill according to claim 3, wherein said intermediate roll has an effective working surface less in longitudinal length than that of each of said work rolls.

5. A rolling mill according to claim 3, wherein each of said backup rolls has an effective working surface less in longitudinal length than the width of the material to be rolled.

6. A rolling mill according to claim 3, further comprising means respectively associated with said upper and lower backup rolls to apply bending forces thereon.

7. A rolling mill acording to claim 6, wherein each of said backup rolls has an effective working surface less in longitudinal length than that of said intermediate roll.

8. A rolling mill according to claim 7, wherein said intermediate roll has an effective working surface less in longitudinal length than that of each of said work rolls.

9. A rolling mill according to claim 7, wherein each of said backup rolls has an effective working surface less in longitudinal length than the width of the material to be rolled.

10. A rolling mill according to claim 2, wherein said the other work roll is the lower work roll, and said mill further comprises means for driving said lower work roll to rotate the same.

11. A rolling mill according to claim 10, wherein said drive means includes a motor common to said intermediate roll and said lower work roll.

12. A rolling mill according to claim 10, wherein said drive means includes two separate motors connected to said intermediate roll and said lower work roll, respectively.

13. A rolling mill according to claim 1, further comprising another intermediate roll interposed in the other of said positions, and means associated with said another intermediate roll to apply bending forces thereon.

14. A rolling mill according to claim 13, wherein each of said upper and lower backup rolls has an effective working surface less in longitudinal length than that of said first-mentioned intermediate roll and said another intermediate roll.

15. A rolling mill according to claim 14, wherein each of said first-mentioned intermediate roll and said another intermediate roll has an effective working surface less in longitudinal length than that of said work rolls.

16. A rolling mill according to claim 14, wherein each of said backup rolls has an effective working surface less in longitudinal length than the width of the material to be rolled.

17. A rolling mill according to claim 13, further comprising means respectively associated with said upper and lower work rolls to apply bending forces thereon.

18. A rolling mill according to claim 17, wherein each of said backup rolls has an effective working surface less in longitudinal length than that of each of said first-mentioned intermediate roll and said another intermediate roll.

19. A rolling mill according to claim 18, wherein each of said first-mentioned intermediate roll and said another intermediate roll has an effective working surface less in longitudinal length than that of each of said work rolls.

20. A rolling mill according to claim 18, wherein each of said backup rolls has an effective working surface less in longitudinal length than the width of the material to be rolled.

21. A rolling mill according to claim 13, further comprising means associated with said upper and lower backup rolls to apply bending forces thereon.

22. A rolling mill according to claim 21, wherein each of said backup rolls has an effective working surface less in longitudinal length than that of each of said first-mentioned intermediate roll and said another intermediate roll.

23. A rolling mill according to claim 22, wherein each of said first-mentioned intermediate roll and said another intermediate roll has an effective working surface less in longitudinal length than that of each of said work rolls.

24. A rolling mill according to claim 22, wherein each of said backup rolls has an effective working surface less in longitudinal length than the width of the material to be rolled.

25. A rolling mill according to claim 13, further comprising means respectively associated with said upper and lower backup rolls to apply bending forces thereon.

26. A rolling mill according to claim 25, wherein each of said backup rolls has an effective working surface less in longitudinal length than that of each of said first-mentioned intermediate roll and said another intermediate roll.

27. A rolling mill according to claim 26, wherein each of said first-mentioned intermediate roll and said another intermediate roll has an effective working surface less in longitudinal length than that of each of said work rolls.

28. A rolling mill according to claim 26, wherein each of said backup rolls has an effective working surface less in longitudinal length than the width of the material to be rolled.

29. A rolling mill, comprising:

a pair of upper and lower cylindrical work rolls, each rotatably mounted about parallel axes in a common plane, and defining therebetween a nip for passing sheet material to be rolled therethrough in a direction perpendicular to said common plane;

upper and lower cylindrical backup rolls, each rotatably mounted about parallel axes within said common plane and respectively backing said upper and lower work rolls;

an intermediate cylindrical roll rotatably mounted about an axis within said common plane, and said intermediate roll being interposed between and in direct continuous line engagement with each of one of said work rolls and the corresponding one of said backup rolls, and said intermediate roll having a diameter and rigidity greater than that of said one work roll and a diameter less than the diameter of said backup rolls; and means directly coupled to opposite axial ends of said intermediate roll to apply bending forces directly to said opposite ends of said intermediate roll axially outside said lines of contact to directly change the contour of said intermediate roll within said plane and thereby indirectly change the contour of the adjacent work roll by engagement therewith along said line of contact.

30. A rolling mill according to claim 29, wherein said means to apply bending forces selectively applies bending forces to change the contour of said intermediate roll so that its line of contract with said working roll is convex with respect to the nip in one mode of operation and concave with respect to the nip in another mode of operation.

31. A rolling mill according to claim 30, further including a second intermediate roll rotatably mounted about an axis within said common plane, said second intermediate roll being interposed between and in direct continuous line engagement with the other of said work rolls and the corresponding other of said backup rolls; and second means directly coupled to the opposite axial ends of said intermediate roll axially outside of its line of contact with said other work roll to apply bending forces directly to said opposite ends of said second intermediate roll to change the contour of said second intermediate roll within said common plane and thereby indirectly change the contour of the adjacent other work roll, and said second means to apply bending forces selectively applying bending forces to change the contour of said second intermediate roll so that its line of contact with said other work roll is concave with respect to said nip and applying bending forces to said second intermediate roll so as to change its contour within said common plane so that its line of contact with said other work roll is convex with respect to said nip.

32. A rolling mill according to claim 29, further including a second intermediate roll rotatably mounted about an axis within said common plane, and said second intermediate roll being interposed between and in direct continuous line engagement with the other of said work rolls and the corresponding other of said backup rolls; and second means directly coupled to the opposite axial ends of said second intermediate roll to apply bending forces directly to said opposite axial ends of said intermediate roll axially outside of its line of contact with said other work roll to change the contour of said second intermediate roll within said plane and thereby indirectly change the contour of the adjacent other work roll through engagement therewith.

* * * * *